US008919430B2

(12) United States Patent
Baker

(10) Patent No.: US 8,919,430 B2
(45) Date of Patent: Dec. 30, 2014

(54) BLOWOUT CONTAINER

(76) Inventor: Dwight Baker, Eagle Pass, TX (US)

( * ) Notice: Subject to any disclaimer, the term of this patent is extended or adjusted under 35 U.S.C. 154(b) by 69 days.

(21) Appl. No.: 13/452,822

(22) Filed: Apr. 20, 2012

(65) Prior Publication Data

US 2013/0126153 A1 May 23, 2013

Related U.S. Application Data

(60) Provisional application No. 61/517,453, filed on Apr. 20, 2011.

(51) Int. Cl.
*E21B 33/06* (2006.01)
*E21B 29/02* (2006.01)

(52) U.S. Cl.
CPC ..... *E21B 33/06* (2013.01); *E21B 29/02* (2013.01)
USPC ..... 166/85.4; 166/84.3

(58) Field of Classification Search
CPC ..... E21B 29/08; E21B 33/063
USPC ..... 166/85.4, 86.3, 84.3
See application file for complete search history.

(56) References Cited

U.S. PATENT DOCUMENTS

| | | | | |
|---|---|---|---|---|
| 3,837,356 | A | 9/1974 | Selep et al. | |
| 4,529,169 | A | 7/1985 | Johns et al. | |
| 4,997,162 | A | 3/1991 | Baker et al. | |
| 5,143,348 | A | 9/1992 | Baker et al. | |
| 5,211,373 | A | 5/1993 | Baker | |
| 5,377,955 | A | 1/1995 | Baker | |
| 2011/0297396 | A1 * | 12/2011 | Hendel et al. | 166/379 |
| 2013/0220631 | A1 * | 8/2013 | Wilie | 166/363 |

FOREIGN PATENT DOCUMENTS

GB 2304860 * 3/1997

* cited by examiner

*Primary Examiner* — William P Neuder
(74) *Attorney, Agent, or Firm* — Kammer Browning PLLC

(57) ABSTRACT

A system for containing and recovering from the blowout of an oil or gas well. The blowout containment (BOC) system is operable in place of, or as a failsafe alternative to, standard blowout preventer (BOP) systems. The BOC system includes a hydraulically operated gate valve positioned over the well at the wellhead. The gate valve includes a check valve operable when the gate valve is closed. The BOC system further includes at least one shearing assembly positioned over the gate valve. The shearing assembly orients explosive charges into the well flow path. An activation trigger detonates the explosive charges to clear the well flow path of obstructions to permit the gate valve to close. Operation of the BOC system is preferably monitored and controlled from a remote location apart from the rig associated with the well.

14 Claims, 8 Drawing Sheets

BLOWOUT CONTAINER

CROSS REFERENCES TO RELATED APPLICATIONS

This application claims the benefit under Title 35 United States Code §119(e) of U.S. Provisional Application 61/517,453, filed Apr. 20, 2011, the full disclosure of which is incorporated herein by reference.

BACKGROUND OF THE INVENTION

1. Field of the Invention

The present invention relates generally to valves, and more particularly, but not by way of limitation, to an improved gate valve for controlling the flow of fluids from a well during wild well blowouts. The present invention relates further to devices for shearing/severing any and all drilling tools inside a drilling blowout preventer (BOP), or likewise all the pipe or tubing inside the largest casing size during the production phase for land and subsea service. The present invention therefore relates to an improved gate valve for controlling the flow of drilling fluids and hydrocarbon fluids and gases in a state of free flow known as blowout in drilling and production phases, in combination with a shearing device for clearing the blowout flow path of obstructions that would otherwise prevent the closure of the gate valve.

2. Description of the Related Art

The control and containment of free flowing drilling fluids, hydrocarbon fluids and gases is critical. To this end the present day blowout preventers (BOPS) have a long history of failure. In particular the shear rams commonly used today are hydraulic operated and are typically only designed to cut the tube section of the drill pipe being used. In addition, shear rams rely for proper placement and function on the drill pipe being in a center position of the hole to cut or sever the drill pipe tube only. Most blowouts, however, occur during the tripping phase of drilling and as a result, other drilling tools such as drill collars and/or down hole tools are frequently within the section to be closed. A second significant cause for failure of blowout preventers used today results from the fact that typically only the body of the BOP is tested at API recommended pressures. The internal components of BOPs used today rely on elastomeric components installed in grooves to make contact with the body. These elastomeric components will generally not contain higher pressures above 5,000 PSI. Therefore, the BOPs in use today are significantly overrated for higher pressures.

Likewise, the blind rams typically used in BOPs currently are manufactured in the same manner using elastomeric components installed in grooves to make contact with the inside of the BOP bodies to provide a sure seal, but as with shear rams, the elastomeric components will only retard and contain pressures up to 5,000 PSI. The entire stack of most BOPs in use today is therefore typically overstated (and thus overrated) in the pressures they will contain.

Other deteriorating effects can cause BOP failure. For example because of the abrasive and often times corrosive nature of drilling fluids and methods used in drilling today the BOP bodies do not retard those things from invading between the BOP body and blowout preventer parts installed. Therefore each time the preventer is moved from one well being drilled to another a full tear down must ensue. The cost of doing is monumental and takes a great deal of time, thus resulting in down time for the rig where the BOP was assigned to work.

All the problems discussed above, as well as others, increase operating costs and increase the chance of injury due to equipment failure. Thus, a need has long existed for an improved gate valve and shearing assembly. Therefore the improved gate valve presented in essence acts in place of, or as a supplement to the blind rams used today. The improved design features hard sealing surfaces resistant to galling and scratching and which is designed to prevent the invasion of drilling fluids free flowing gases and fluids into the valve body therefore the valve lubricant stays in place for multiple use without expensive tear downs after each well all the while being inexpensive to manufacture, easy to maintain and convenient to operate.

Recent offshore production blowout events have peaked interest in how to bring about a cure when commodity blowout preventers fail. Therefore the present improvements are directed to the gate valve field. The improved gate valve can be used to stop an entire blowout pressure flow, and hold back that flow until other measures may be used to kill the well and/or cement the formation. A further obstacle to a failsafe system however, is how to cut and demolish all objects in the flow path that the gate would have to pass through to stop the flow.

The second critical component of a failsafe solution is therefore a system for directing an implosion of the steel parts inside in the through-bore being drilled. This implosion would allow the gate to pass from open to close. A critical issue in this regard relates to the actual placement of the shearing components with respect to the operable gate valve. The preferred placement of the shearing assembly is on top of the gate valve. In this manner of placement, at the time of implosion, the top pipes would snap back up toward the rig and the bottom pipes would fall down into the hole due to gravity. This process results in creating a clean path for the gate to pass from open to close.

Another important feature of the present invention relates to the events following the gate valve closure that would allow recovery of the well. The solution was to install a high-pressure fail-safe check valve in the center of the gate during the manufacturing process. Thereby when normal drilling activities were restored mud and other agents could be pumped down the hole through the check valve to regain control. Once the pressures were equalized the valve could be opened again allowing full openings to the hole for work to re-commence.

The design of the gate valve of the present invention may be generally seen as a modification of the gate valve structure disclosed in U.S. Pat. No. 5,377,955, issued in the name of the present Applicant/Inventor, the full disclosure of which is incorporated by reference. The gate valve design has internals that are unique that provides added protective provisions to restrict flowing fluids and gases from entering the valve body while in the open position.

In general drilling activities involves the injection of drilling fluids to aid the bit in penetration of the solids, and then the drilling fluids carry back the drill bit cuttings. Therefore when the valve is full open none of those returning solids will penetrate inside the gate valve body. Hence the lifetime of the gate valve is enhanced.

During times of well blowout the fluids and gases will pass through the open position of the gate valve. During blowout larger and harsher debris may be free flowing, also the pressures may be greatly increased because stable drilling pressures have been compromised. Therefore the valve body by not being filled with flow through fluids will operate freely from open to close in an instant.

During blowout the instant the hydraulic valve closes. Shock waves caused by the sudden stop of fluids and gases have little to no effect on the valves internals. Also the encroachments of solids and gases inside the valve body have been reduced by the design of the internal valve parts, metals used metallurgy applied and assembly techniques. Thus the valve stellar design engineering and manufacturing processes has proven to be the far improved and more reliable control of free flowing fluids and gases during blowout and for the sub sea ultimate containment of such while work resumes to again gain control.

The fail safe blowout container of the present invention is designed to repeat its work over again after blowout without being removed brought back to surface for repair or upgrade. Thus this giant leap forward using the Fail Safe Blowout container will move sub sea oil and gas exploration drilling completion and production into a much safer arena for all concerned. While at the same time bring about a more sane control of the capital set back to cure wild well blowouts. While at this time has many good solid oil and gas entities held in a quagmire of financial jeopardy because of the risk involved using present day blowout prevention prior Art.

Held inside the shear/destroy spool are the shot rings; the number of those needed for each separate well design are at the option of the oil and gas producer. Thus again providing the needed control of the total drilling completion and production of sub sea oil and gas in the control of each producer and to which government agencies and countries that are in control of those assets.

The blowout containment system becomes the one product in the production of subsea oil and gas that must be prepared for use using the most recent technological advances in engineering, manufacturing techniques metals used, metallurgy and assembly techniques.

SUMMARY OF THE INVENTION

A blowout container system designed for the major control of flowing fluids and gases during oil and gas well blowouts. The blowout container would be installed below the present blowout preventer stacks, and remain there during all drilling completion and production cycles throughout the lifetime of the well. Atop the blowout container all wellheads and production equipment would be installed. In the event of mishaps of blowouts and/or oil and gas seepage coming from inside the primary casing. The blowout container when activated via an umbilical tie back line to the surface would activate the shear/destroy elements inside their spool all pipes in the internal confines of the surface pipe inside diameter would be destroyed by implosion. All pipes would react the above pipes would snap back upward and pipes below would fall down the hole via gravity. Following that the gate valve would close hydraulically and seal tight. When operations could commence again pumping of kill fluids could pass through the check valve housed inside of the gate in valve. Once overburdening pressures were neutralized, the gate could be opened again then operations could commence as required. Thereby providing the most cost effective and needed safe guard during the drilling completion and production cycles of the well.

Inside the inner workings of the gate valve body housing would be sufficient space to house DC electric drive hydraulic pumps along with the reservoirs to contain hydraulically pressured up oils for operating the valve from open to close and then from close to open as required. Inside the shear/destroy spool would be installed a number of shot rings securing the shaped charges in a 360° horizontal pattern. The shaped charges would have the power to destroy all, in the inside diameter of pipe used as primary casing string. Therefore the destroying power found in the shot rings would be realized as the charges met one another then expanded exponentially in implosion. Drill pipe joints, drill collars, and other large diameter tools used in drilling have never been cut through by commodity blowout preventer shear rams. Thus making their shear rams of no consequence, therefore the present blowout control in those cases has been the use of annular blowout preventer that has a tight sealing capacity of about 5,000 PSI. But only when they are in a prefect state of repair and that is not often found during drilling activities.

Control and power to operate the shear/destroy elements inside their spool would be supplied through the umbilical tie back line. Also through that line the batteries for the DC electric drive hydraulic pumps would be charged as needs be. A series of monitors for each device would send out information through the umbilical tie back line. And would likewise receive as required. Those skilled in the art will recognize the standard use of the same electronics used in the control devices in or on the fail safe blowout container known in the art in umbilical lines for subsea connectivity. On the sea surface in subsea efforts the controls for the blowout container would be installed on a buoy, flotilla or ship, or the production platform and that would depend on what is preferred for the operator at that time.

Inside the inner workings of the gate valve body housing would be sufficient space to house DC electric drive hydraulic pumps along with reservoirs to contain hydraulically pressured up oils for operating the valve from open to close and then from close to open as required. Inside the shear/destroy spool would be installed a number of shot rings securing the shaped charges in a 360 degree horizontal pattern looking inward. The shaped charges would have the power to destroy all, in the inside diameter of pipe used as primary casing string. Therefore the destroying power found in the shot rings would be realized as the charges met one another then expanded exponentially in implosion.

The operation of existing blowout preventers suggest that the shear rams will not cut though then seal drill pipe joints, drill collars, and other large diameter tools used in drilling. Thus making their shear rams of no consequence, therefore the present blowout control in those cases has been the use of annular blowout preventers that has a tight sealing capacity of about 5,000 PSI. But only when they are in a prefect state of repair and that is not often found during drilling activities.

The term blowout means any loss of contaminate of fluids and or gases during all times of drilling, times of production, times of shut in, and times of plug and abandonment. The total fail safe blowout container of the present invention represents the ultimate in blowout containment during all times. The through-bore and the pressure specifications can changed as needed to be used in drilling then in the production phases that once installed will protect the times of shut in and during the times of plug and abandonment.

The problems that exist for some recent operations in the North Sea and Brazil are those that have occurred due to the leaking of the well head equipment valves or seals thus all could have been contained if the total fail safe blowout container of the present invention had been installed on the first flange looking up before those pieces of equipment were installed. Accordingly when the first leaks ensued all piping in the through-conduit could have been cut through followed by closure of the gate valve.

To add to the long term fix install a failsafe blowout container on the first flange looking up prior to installing all wellhead components. Then with it installed lay out sensors to detect leaks of fluids or gases from the sea bed and well head assemblies those sensor would be attached to the umbilical line attached to the on-sight sentry for oversight and alarms.

With the emphasis in ultra deep sea drilling comes the huge risk of dealing with high pressures and high temperatures. Therefore when judging risk compared to rewards the failsafe blowout container will bring a level of safety heretofore not achieved. And to add to that a rig up can ensue to tie back to the well head assemblies that will make the way for heavy drilling mud to be pumped down through the check valve in the closed gate to make a way for the valve to be opened then well intervention can begin. The huge cost of drilling, the cost of insurance, the potential loss of life and the huge environmental cost of clean up can be controlled more by the installation of the production blowout container.

As indicated above, reference is made to U.S. Pat. No. 5,377,955 to which certain changes are made to the gate valve described therein. In each diagram where the gate is displayed a 'T' slot must be utilized along with a threaded female receiver for the check valve to be installed in the center of the gate. The gate is preferably rectangle instead of the shape shown in the referenced patent which will add to the size for the 'T' Slot. The new gate valve and the shearing assembly embody the work known as the total failsafe blowout container.

The shearing assembly is comprised of two forged steel bodies with flanges on one end. The separate bodies are brought together in final assembly after the shot rings required have been installed. That connection is proprietary the patent is soon to be filed. But in the final assembly both separate bodies are sealed with a metal-to-metal compression seal then locked in place not made to be separated. Therefore the shearing assembly has the amount of shot rings as designed and once all are used the entire shearing assembly must be replaced.

The shot rings are manufactured on the inside diameter to the dimensions of the casing set to drill through the normal size used at this time is 19 inch. The outside diameter of the shot rings is designed to be 30 inches, but they may vary as per the vendors selected to provide. The height of each shot ring will be about 10 inches, when in assembly the shot rings will be placed one on another and a separation plate will be installed when the upper and lower shearing bodies are assembled.

A receiver female port and connector will be placed in the best proximity for the umbilical cord to be attached and the use of ultrasonic transducers to inform the shearing assembly and valve center to function. The valve body is studded up and down to receive the connections used in the drilling and production sequences as per required. The through bore on the valve body is off center left to right but end to end it is the center with the other side drilled or forged through to receive in one compartment the hydraulic assembly and holding tank with a DC drive hydraulic pump and in the next compartment but separated by forged steel is the battery compartment both of those compartments are studded on both ends for the placement of the end caps. The umbilical cord or line should go down from the surface vessel or like kind to the blowout container, such that the path of the umbilical cord or line would be the choice of the one operating the system. The preferred approach is to have a sentry (monitoring and control) separate from the drilling rig.

DETAILED DESCRIPTION OF THE PREFERRED EMBODIMENTS

Figure 1:
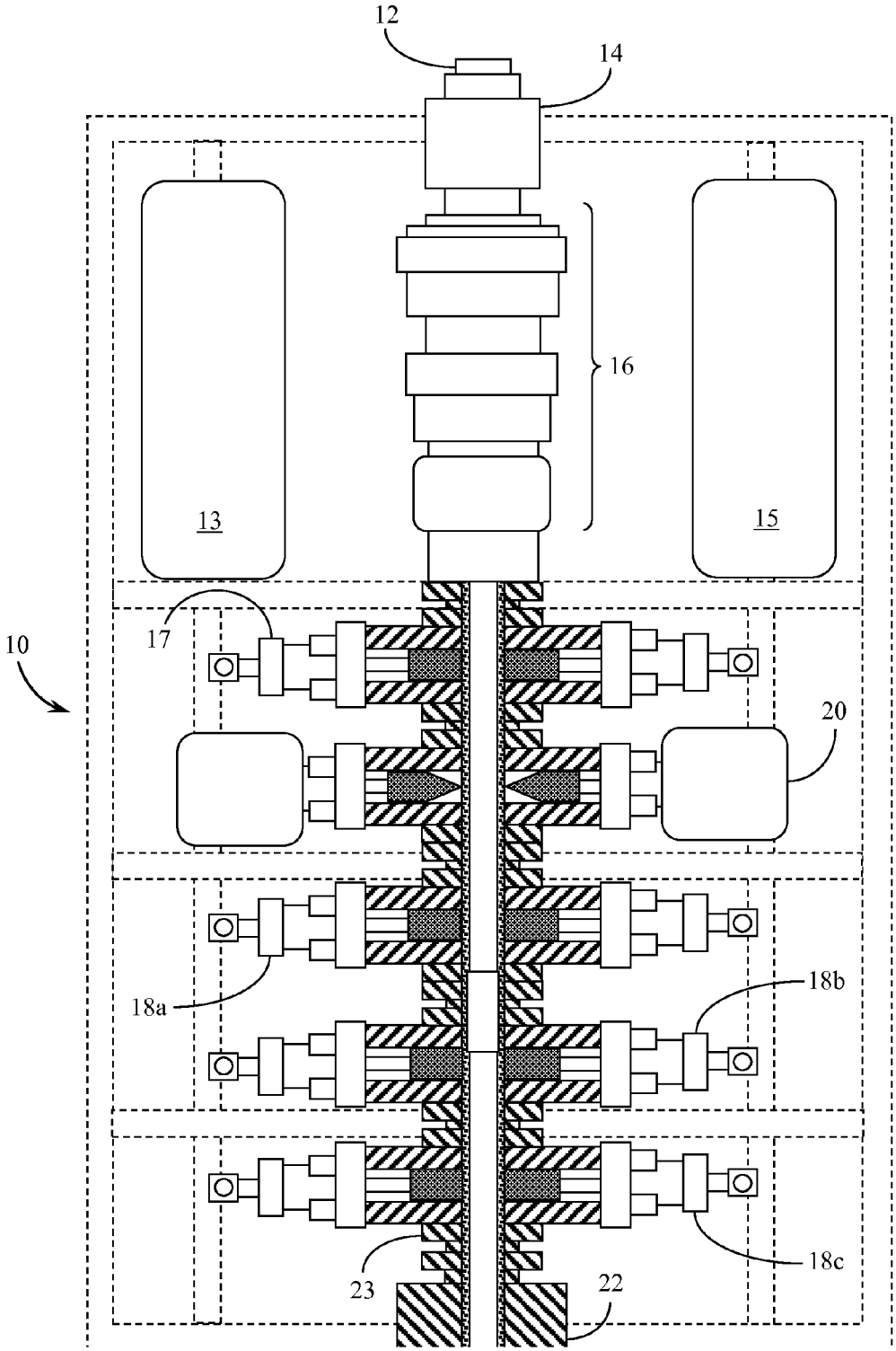
Fig. 1 (Prior Art)
FIG. 1 is a partial cross-sectional elevational side view of a blowout preventer system typical in the prior art.

Reference is made first to FIG. 1 for a description of a typical blowout preventer of the prior art. In FIG. 1 blowout preventer (BOP) 10 is generally constructed in a stack comprising a series of valves developed to prevent an uncontrolled flow if the mud control system is overwhelmed. Extending downward through the stack, the system connects to the surface through riser adaptive 12 connecting to flex joint 14. Below this connection point are typically at least two annular valves designed to close in and seal on the drill pipe. If the drill pipe is not in use, these annular valves close in and shut off the open hole. Various control components are associated with the operation of these elements within the BOP system in control pods 13 & 15.

Below the annular valves 16 are configured a number of ram structures. These include a pipe ram 17, three (for example) blind rams 18*a*-18*c* as well as a shear ram 20. Blind rams can withstand more pressure than the annular valves over open holes. These are not used with drill pipe in place, as the annular valve might be used. Generally rams comprise two metal blocks that close on each other to seal the well. The shear ram is often considered the final failsafe and is designed to close the well by cutting and sealing the drill pipe. In general, however, shear rams are not designed to cut through joints where two pipe sections connect and are ineffective in assisting with the sealing of the well where a drill pipe connecter or other heavy tool component is positioned within the BOP. Also shown in FIG. 2 are well head connecter 22 and a section of drill pipe 24 extending through the BOP.

Figure 2:
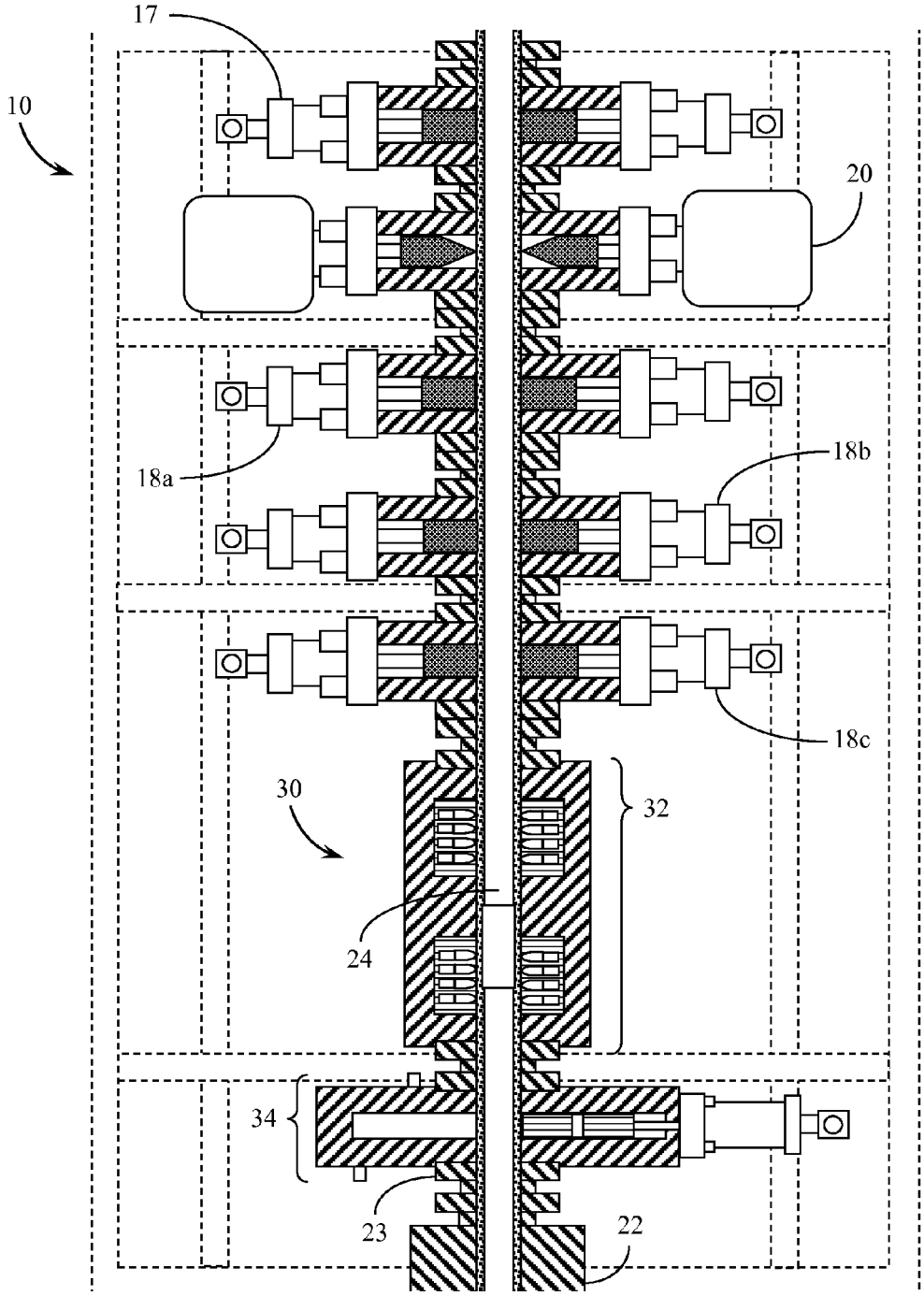
FIG. 2 is a partial cross-sectional elevational side view of the blowout containment (BOC) system of the present invention installed in conjunction with a prior art blowout preventer system.

FIG. 2 shows implementation of the structures of the system of the present invention. In this view the failsafe blowout container (BOC) 30 is constructed below a standard blowout preventer system 10 in a manner that allows it to operate even in the event of a failure of a standard blowout prevention structure. The traditional blowout preventer structure 10 is again shown in FIG. 2 connected to the top of the fail-safe blowout container system 30. The system of the present invention is structured to connect to the well through well head connecter 22 as with the traditional blowout preventer connecter.

Included in the failsafe blowout container of the present invention are gate valve system 34 and implosion shearing system 32. The primary components of the present invention include the gate valve 34 and the shear destruction spool assembly 32. The gate valve 34 of the present invention is structured in many respects similar to that described in U.S.

Pat. No. 5,377,955 issued to the Applicant of the present Application, the full disclosure of which is hereby incorporated herein by reference.

Figure 3A:
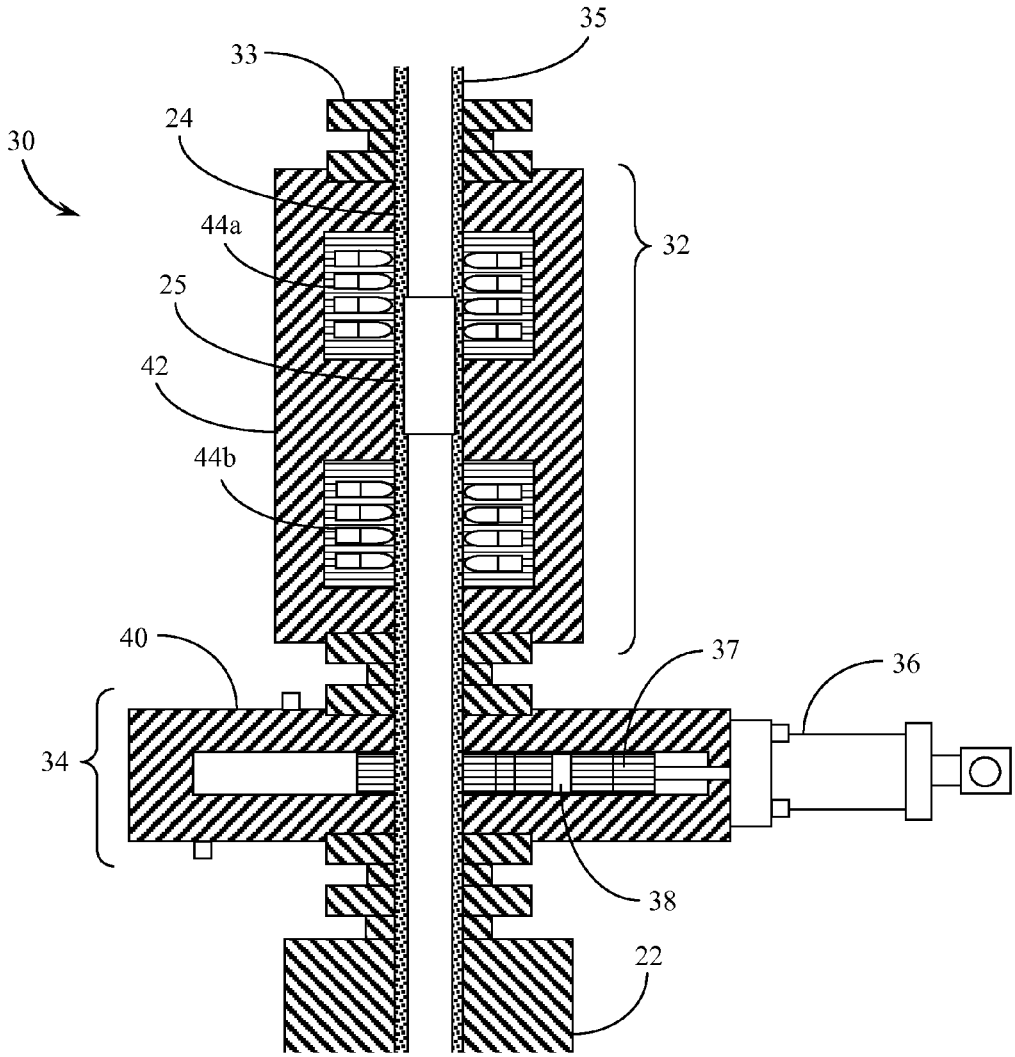
FIGS. 3A-3D are partial cross-sectional elevational side views of the BOC system of the present invention shown in operation from a full open, to a blowout, to a full closed, and a subsequent full open condition.

FIGS. 3A-3D provide views similar as that shown in FIG. 2 and disclose the operation of the system of the present invention from a fully open (operating nominally) system wherein drill pipe extends through the device, to a blowout condition where operation of the device is triggered to contain the blowout. FIG. 3A represents the fully open condition wherein gate valve 34 is fully retracted allowing full access to the well bore for drill pipe 24. In a similar manner, shearing system 32 is structured to be a passive conduit through which the drill pipe and the well extend.

Figure 3B:
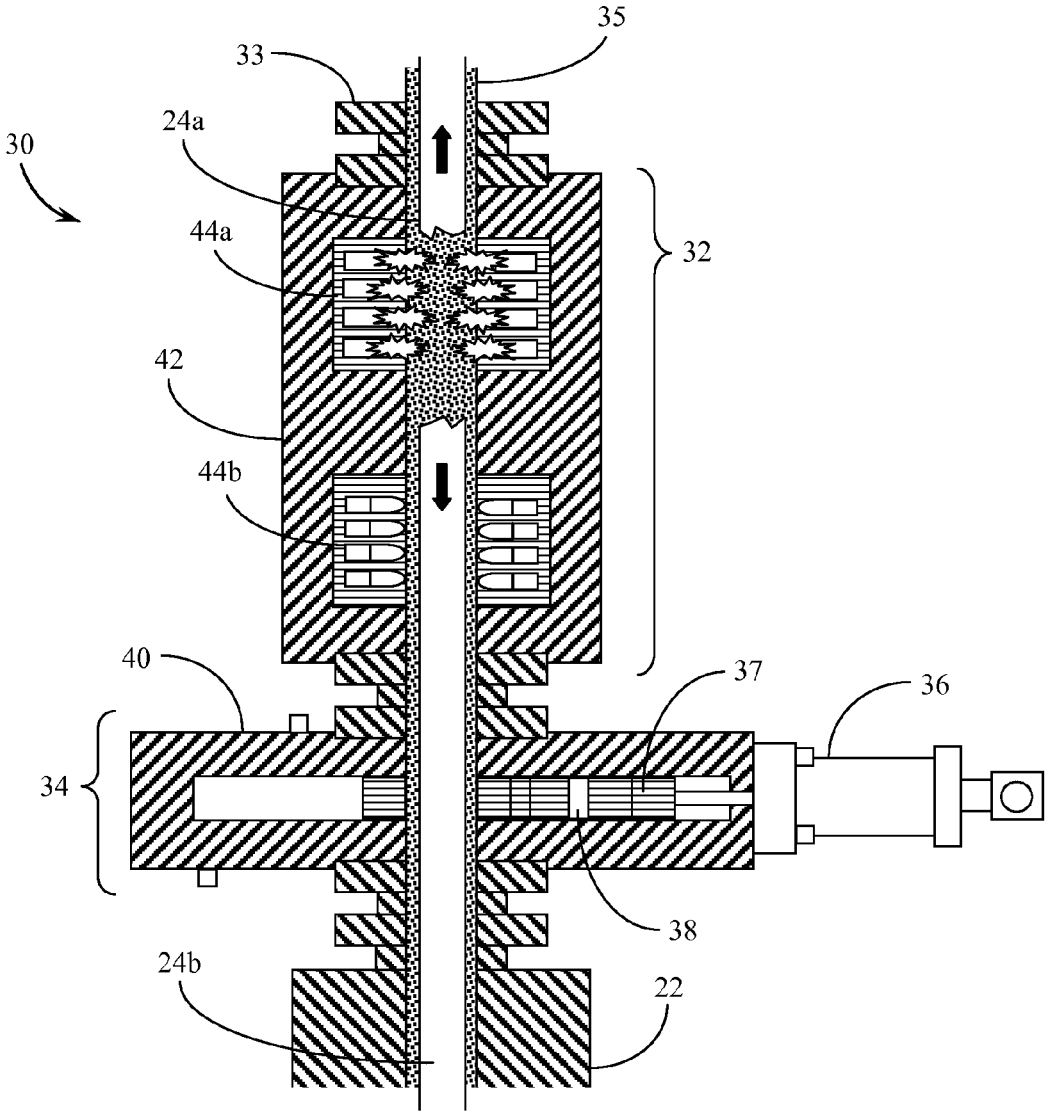

FIG. 3B represents the initial stages of a blowout wherein control of the well has been lost and uncontrolled flow occurs through the system. The initial step in the operation of the present invention is to effect the implosion of the blowout spool in order to fully sever and destroy the drill pipe and any other structurally solid material (collars, couplings, tools, etc.) contained within the enclosure casing and the like, in order to free the well opening within the system of debris and other material that would prevent operation of the gate valve.

Figure 3C:
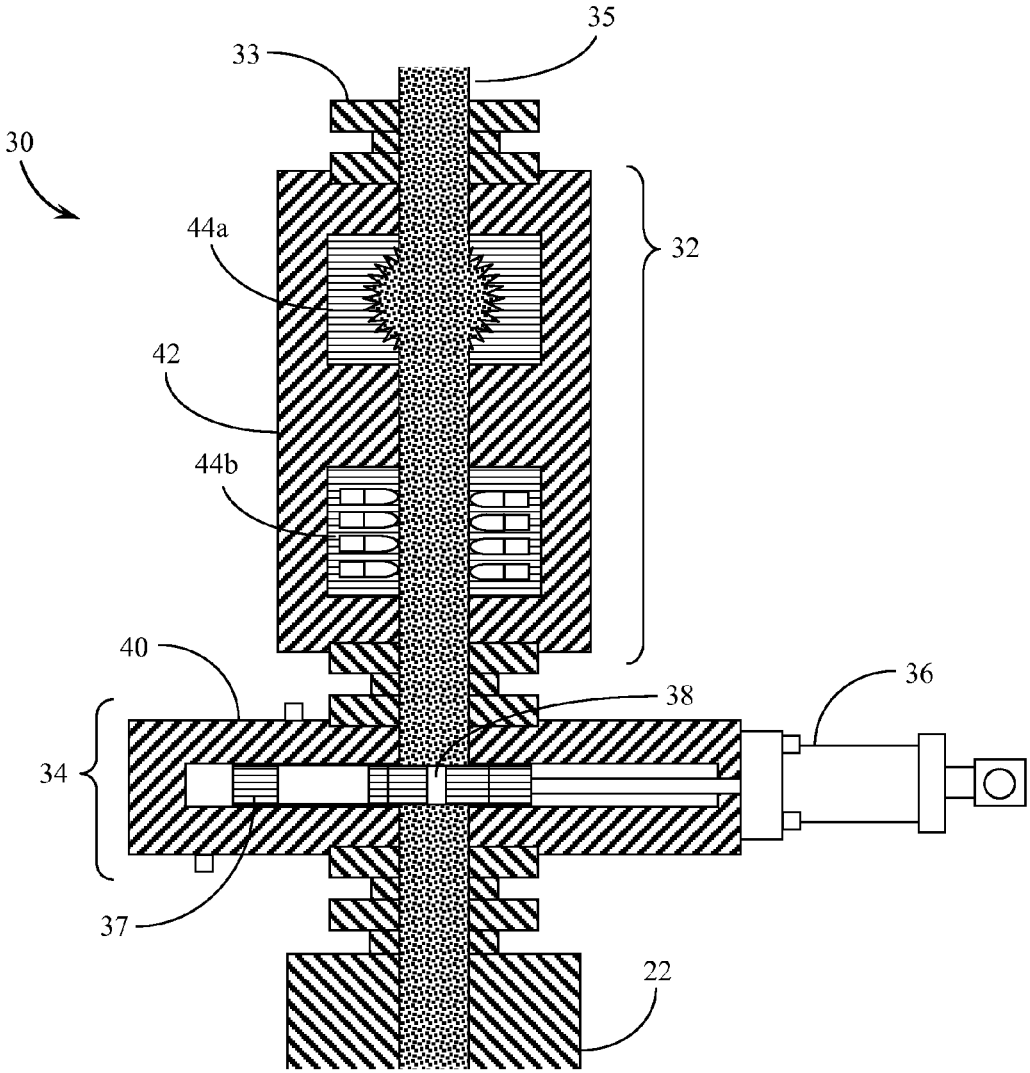

FIG. 3C therefore discloses operation of the gate valve whereby the well has been fully closed in order for recovery and restoration operations to begin. Once fully closed by means of the gate valve, drilling activities may be restored by re-entering the bore hole by initially providing bore hole drill mud through the check valve in the center of the gate valve in order to balance pressures before opening the failsafe valve.

Figure 3D:
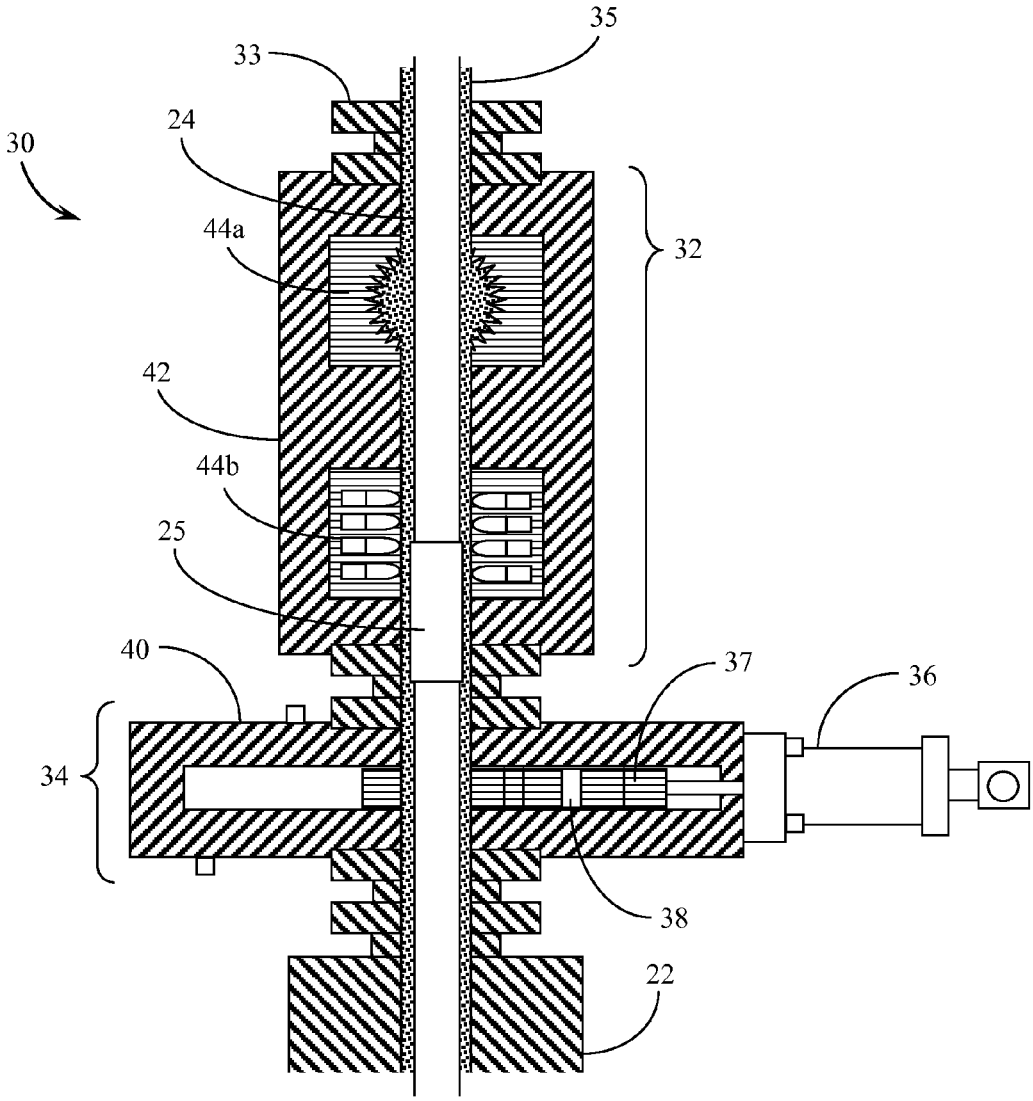

FIG. 3D therefore discloses the subsequent condition wherein a pressure balance has been obtained by pumping drill mud into the well bore and balancing the pressure such that further operation within the well may occur.

FIGS. 3A-3D disclose shearing assembly 32 made up (in this example) of implosion spools 44*a* & 44*b*. These spools are contained (and their implosions are focused by) shearing assembly body 42. Coupling 25 is shown (in FIG. 3A) in a position on drill pipe 24 where a shearing ram would not be able to cut through. Connection to the BOP may be made through connector 33 which maintains flow path 35 into the BOP (not shown). Activation of implosion spool 44*a* could however sever the drill string. Various structures for implosion spools 44*a* & 44*b* are anticipated. These could include the use of armor piercing projectiles followed by incendiary chemicals such as phosphorus to break apart and disintegrate all obstructions within the flow path 35.

FIGS. 3A-3D disclose gate valve 34 to comprise valve body 40 surrounding valve gate 37. Gate 37 is hydraulically moved with hydraulic cylinder 36. Check valve 38 is positioned so as to function when gate valve 34 is closed. Gate valve 34 is preferably positioned directly onto the wellhead 22 as shown. In this manner the BOC system of the present invention may serve as either the first or final line of defense against a blowout, depending on the monitoring and control approach implemented by the operational company. In FIG. 3B the pipe drill string has been severed by the detonation of implosion spool 44*a* and top section 24*a* under tension from above moves upward and out of the flow path while bottom section 24*b* drops into the well under the influence of gravity.

The gate valve of the system of the present invention may be repeatedly operated without requiring replacement in the event of a blowout situation that is cured. The implosion spool system of the present invention may be structured with multiple elements, such that after an initial use as described above in FIG. 3B, operation of the well might continue with a second implosion spool in place to serve as operation for the failsafe blowout container structure. Only after a second such blowout condition would the spool implosion component of the system of the present invention require replacement. Within such condition, however, simple closure of the gate valve and disconnection of the old implosion spool structures may be accomplished with little down time for the operation of the well.

Figure 4A:
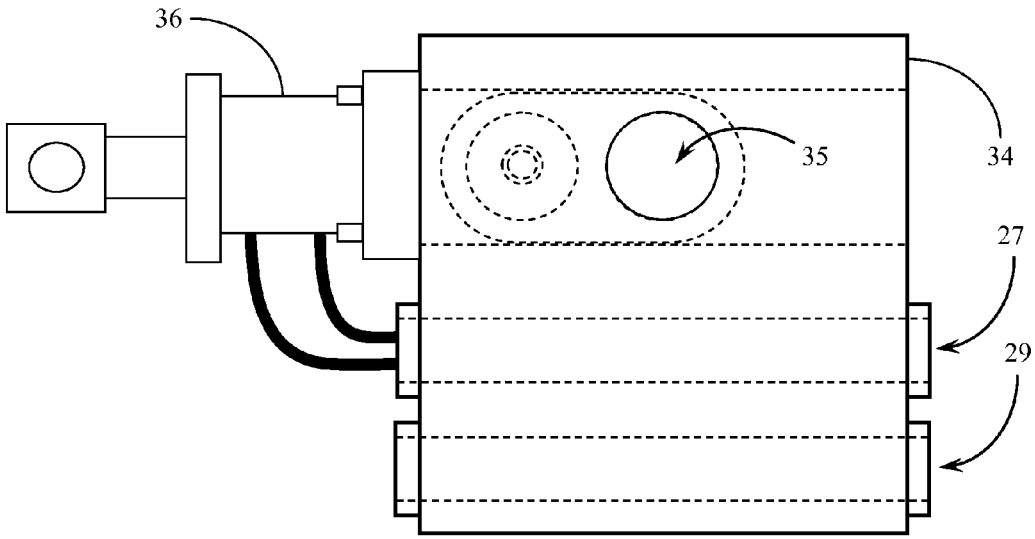
FIG. 4A is a detailed top plan view of the gate valve component of the BOC system of the present invention.

Reference is next made to FIG. 4A for a detailed view of the gate valve 34 of the present invention. In this view the open and closed positions of the moving gate across the flow path 35 may be more clearly seen. Also shown are preferred placements of hydraulic systems 27 and power systems 29 that together provide the local operational power source for activation of the hydraulic cylinder 36 for functioning of the valve.

Figure 4B:
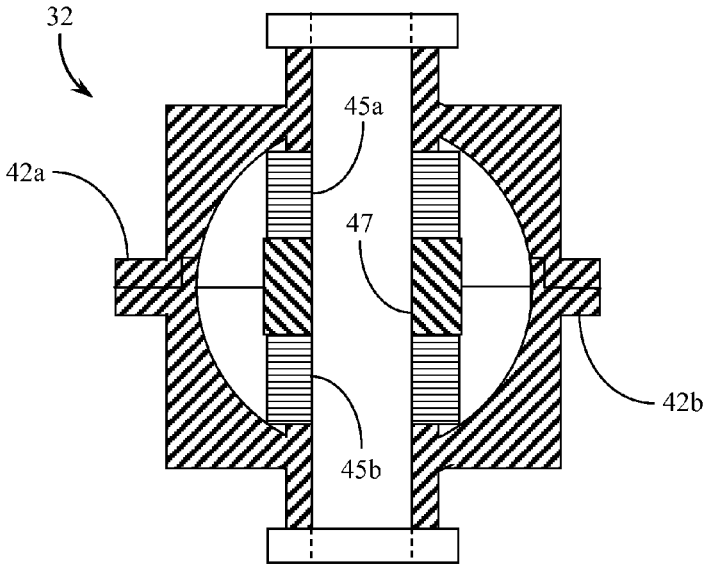
FIG. 4B is a detailed partial cross-sectional elevational side view of an alternate structure of the shearing assembly of the BOC system of the present invention.

FIG. 4B provides a detailed partial cross-sectional view of an alternate embodiment of the shearing assembly 32 of the BOC of the present invention. In this embodiment, the enclosure is made up of a metal to metal sealed clam-shell type structure that surrounds the flow path and positions implosion spools 45*a* and 45*b* on either side of a separation pipe section 47. In this manner a focused blast from the implosion spools can occur.

Figure 5:
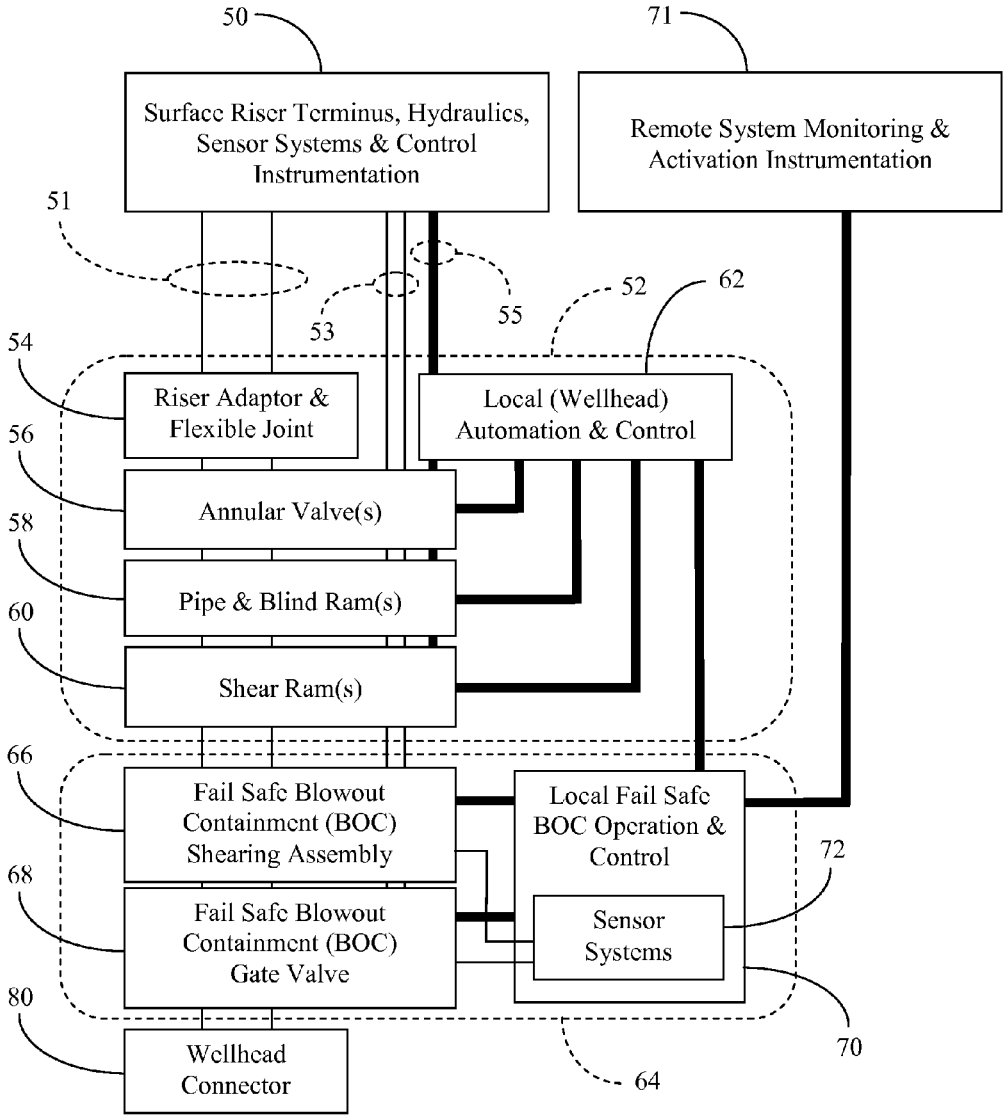
FIG. 5 is a schematic block diagram showing the essential components of the system of the present invention and the control systems associated with its operation.

Reference is finally made to FIG. 5 which is a schematic block diagram showing the various functional components of the system of the present invention and the various connections to surface and remote control instrumentation. Component 50 provides surface riser terminus, hydraulics, sensor systems and control instrumentation as might typically be positioned on the rig associated with the well. Component 71 provides a remote system monitoring and activation instrumentation at a separate location as described above. The drill line 51 extends to riser adaptor and flexible joint 54 as typical. The BOP system 52 is typically made up of annular valves 56, pipe and blind rams 58, and shear rams 60. Each of these BOP components may be connected through local automation and control pods 62 as shown. Hydraulic lines 53 and electrical/signal lines 55 are also shown.

The BOC system 64 is shown positioned over wellhead connector 80 and includes the various components described above. BOC shearing assembly 66 is position over BOC gate valve 68 and are each operably connected to local BOC operation and control pod 70 which includes sensor systems 72 as described above. Again, an important feature of the present invention is its connection to both the surface riser terminus 50 and the remote system instrumentation 71. Under this mode of operation the present invention truly approaches a failsafe status with operation being controlled in a location apart from the devastating effects of an uncontrolled blowout condition.

The BOC or BOP umbilical cord going upward to the sentry system with personnel stationed is not being done today. Now, two beneficial operating modes may exist, one for the drilling operation and another for the production period. During the production period the attached monitors installed on the seabed around the perimeter of the well head would inform the sentry on duty of leaking hydrocarbons. After which decisions could be made as what to do and how, but the installed blowout container could be used to cut the tubing then the valve would close cutting off all hydrocarbons coming from the production formation. Therefore the leaks would be stopped.

The user of the system of the present invention would not only have the drilling business but also have the same on the production side. The production side could very well be the one to provide the greatest revenue stream. If fact some of the pre-salt wells may last for 20 to 30 years.

Last the metallurgy used in manufacturing the gate and seats in the patent listed are of vital importance. Reference is again made to U.S. Pat. No. 5,377,955 for a detailed description of the preferred metallurgy characteristics of the gate valve of the present invention.

Although the present invention has been described in terms of the foregoing preferred embodiments, this description has been provided by way of explanation only, and is not intended to be construed as a limitation of the invention. Those skilled in the art will recognize modifications in the present invention that might accommodate specific educational presentation environments and systems. Such modifications as to structure, method, and even the specific arrangement of components, where such modifications are coincidental to the educational instructional environment or the specific subject matter being presented, do not necessarily depart from the spirit and scope of the invention.

I claim:

1. A system for containing and recovering from blowout of an oil or gas well having a well flow path, the system operable in place of, or as a failsafe alternative to, standard blowout preventer systems, the system comprising:

a hydraulically operated gate valve positioned over the well at a wellhead, the gate valve alternating between a full open position and a full closed position, the gate valve further comprising a check valve operable to permit fluid flow into the well but not out from the well, the check valve operable when the gate valve is in the full closed position; and at least one shearing assembly positioned over the gate valve opposite the wellhead, the shearing assembly comprising at least one implosion spool oriented into a cylindrical axis of the wellbore and operable to detonate explosive charges within the at least one implosion spool;

wherein operation of the system activates and detonates the explosive charges within the at least one implosion spool to clear the well flow path of any obstructions so as to permit the movement of the gate valve to the full closed position.

2. The system of claim 1 wherein the at least one shearing assembly comprises at least two shearing assemblies, each shearing assembly independently operable to clear the well flow path of any obstructions so as to permit the movement of the gate valve to the full closed position.

3. The system of claim 2 wherein the at least two shearing assemblies are separated by a barrier to prevent activation of and/or damage to a second shearing assembly upon activation of the first shearing assembly, wherein damage to the second shearing assembly would prevent it's later independent activation.

4. The system of claim 1 wherein the at least one implosion spool comprises a cylindrical array of explosive charges oriented to exert a major force of explosion (implosion) towards a central axis of the well flow path.

5. The system of claim 1 wherein the at least one implosion spool comprises a plurality of explosive charges operable to break apart and disintegrate obstructions within the well flow path.

6. The system of claim 5 wherein the at least one implosion spool comprises armor piercing projectiles.

7. The system of claim 5 wherein the at least one implosion spool comprises incendiary chemicals.

8. The system of claim 6 wherein the at least one implosion spool further comprises incendiary chemicals operable subsequent to operation of the armor piercing projectiles.

9. The system of claim 1 wherein the at least one implosion spool in the at least one shearing assembly comprises at least two implosion spools.

10. The system of claim 9 wherein the at least one shearing assembly comprises a clam-shell enclosure defining a generally spherical internal wall surface, the at least one shearing assembly further comprising a medial separation pipe section, the at least two implosion spools positioned within the clam-shell enclosure, the medial pipe separation pipe section positioned generally between the at least two implosion spools, wherein detonation of the at least two implosion spools results in a centrally focused blast.

11. The system of claim 1 further comprising an operation and control device positioned proximate to the at least one shearing assembly and the hydraulically operated gate valve.

12. The system of claim 1 further comprising an operation and control device positioned apart from the at least one shearing assembly and the hydraulically operated gate valve.

13. The system of claim 1 further comprising a sensor system positioned proximate to the at least one shearing assembly and the hydraulically operated gate valve, the sensor system operable to detect and report a condition of the at least one shearing assembly as activated or not and the hydraulically operated gate valve as open or closed.

14. The system of claim 13 further comprising remote monitoring instrumentation connected to the sensor system to remotely report a condition of the at least one shearing assembly as activated or not and the hydraulically operated gate valve as open or closed.

* * * * *